US006203219B1

(12) United States Patent
Sakata

(10) Patent No.: US 6,203,219 B1
(45) Date of Patent: Mar. 20, 2001

(54) PHOTOSENSITIVE MATERIAL PROCESSING APPARATUS

(75) Inventor: Masamitsu Sakata, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/124,053

(22) Filed: Jul. 29, 1998

(30) Foreign Application Priority Data

Aug. 22, 1997 (JP) ..... 9-225979

(51) Int. Cl.[7] ..... G03D 3/08
(52) U.S. Cl. ..... 396/612; 396/617; 396/619
(58) Field of Search ..... 396/612, 620, 396/619, 626, 627; 134/64 P, 122 P; 226/108, 182, 188

(56) References Cited

U.S. PATENT DOCUMENTS 4,295,729 * 10/1981 Kaufmann ..... 396/626
4,931,378 * 6/1990 Hirano et al. ..... 396/620
4,954,838 * 9/1990 Nakamura et al. ..... 396/626
5,043,756 * 8/1991 Takabayashi et al. ..... 396/626
5,168,296 * 12/1992 Nakamura et al. ..... 396/620
5,570,154 * 10/1996 Kurimoto et al. ..... 396/626
5,634,168 * 5/1997 Matsumoto et al. ..... 396/612
5,669,035 * 9/1997 Kurematsu et al. ..... 396/626

* cited by examiner

*Primary Examiner*—D. Rutledge
(74) *Attorney, Agent, or Firm*—Sughrue, Mion, Zinn, Macpeak & Seas, PLLC

(57) ABSTRACT

When gears which drive rollers for transporting photographic printing paper are rotated to thereby transport the photographic printing paper, shutters retract from a photographic printing paper passage and rollers rotate so that the photographic printing paper is transported.

When the gears are reversed after the completion of the transport of the photographic printing paper, the shutters block the photographic printing paper passage and are located above the rollers which protrude in the photographic printing paper passage to thereby prevent floating materials such as silver, sulfide, soiling and the like from precipitating on the surfaces of the rollers.

16 Claims, 5 Drawing Sheets

PHOTOSENSITIVE MATERIAL PROCESSING APPARATUS

BACKGROUND OF THE INVENTION

1. Field of the Invention

The present invention relates to a photosensitive material processing apparatus for processing a photosensitive material by immersing the photosensitive material in a processing solution contained in a processing tank. More particularly, the invention relates to a photosensitive material processing apparatus wherein feed rollers nip a photosensitive material to transport it into a processing tank.

2. Description of the Related Art

In a photosensitive material processing apparatus for developing a photosensitive material such as photographic printing paper, the photosensitive material is processed by immersing it in a processing solution contained in a processing tank.

The photosensitive material is generally nipped by feed rollers and transported into the processing tank, and processed in the processing solution while being conveyed.

Floating materials such as silver, sulfide, soiling and the like are floating in the processing solution. The floating materials adhere in part to the rollers through deposition or adsorption and are transferred onto the photosensitive material, resulting in deterioration of the quality.

A photofinishing laboratory typically shuts down the apparatus in the evening and starts it again either the next morning or the morning two days later (if, for example, the morning is after a holiday).

When the apparatus which was shut down for a long time is started so that the first photosensitive material to be processed passes between the rollers, the floating materials adhered to the feed rollers may transfer to the photosensitive materials and deteriorate the quality of the photosensitive material.

Further, when photosensitive materials with different widths are processed, only a small amount of floating materials adhere to and accumulate on the areas which frequently nip the photosensitive materials, causing no deterioration of the quality of the photosensitive materials. On the other hand, floating materials accumulate for a long period on the areas which are less frequently used, resulting in the inferior quality of the photosensitive materials.

SUMMARY OF THE INVENTION

With the aforementioned in view, an object of the present invention is to provide a photosensitive material processing apparatus in which the quality of the photosensitive material does not deteriorate when the apparatus is shut down for a long time or photosensitive materials with different widths are processed.

The operating environments of a photosensitive material processing apparatus include a photosensitive material processing state, a heat control state (only the circulation pump is operating while the processor is not driven), and a shutdown state. The amount of floating materials adhering to the rollers varies in the respective states.

In the photosensitive material processing state, only a small amount of floating materials accumulates as the processing solution in the processing tank or so-called tank solution is circulating. Moreover, the agitation effect caused by the surfaces of the rollers as they rotate allow only a small amount of floating materials to adhere to the rollers. Namely, in the processing state of the photosensitive material, floating materials do not accumulate on the surfaces of the rollers in such an amount that soiling transfers to the photosensitive materials.

In the heat control state where the circulation pump is in operation, the accumulation of the floating materials in the solution can be reduced to a minimum as the tank solution is circulating. However, as the rollers are kept stalled for a long time, localized accumulation of the floating materials occurs, resulting in the deterioration of the quality of the photosensitive materials.

In the apparatus shutdown state, the floating materials easily accumulate on the rollers as the tank solution is static. As the rollers are static, the accumulations are concentrated locally on the nip areas of pairs of rollers. Therefore, this is the state where soiling occurs especially easily.

In order to prevent the deterioration in quality on the surfaces of the rollers after a long apparatus shutdown or when the surfaces of the rollers have not nipped a photosensitive material for a lengthy period, it is imperative to prevent the floating material from adhering to the rollers as occurs in the shutdown state and the heat control state.

A photosensitive material processing according to a first embodiment of the present invention comprises a processing tank for processing said photosensitive material by immersing the photosensitive material in a processing solution contained therein, feed rollers provided in said processing tank for nipping and transporting said photosensitive material, and shutters retractably provided above said feed rollers.

The operation of the present photosensitive material processing apparatus of the first embodiment will now be described.

In the photosensitive material processing apparatus, the photosensitive material is transported into the processing tank by the feed rollers so as to be processed in a predetermined manner by the processing solution contained in the processing tank.

When the processing of the photosensitive materials is not conducted for a long time, such as a holiday or during the night, or when the apparatus is in the heat control state, the shutters are disposed above the feed rollers. This can prevent the floating materials in the processing solution from precipitating on the feed rollers.

When the photosensitive material is processed, the shutters are retracted from the feed path of the photosensitive material.

Preferably, the shutters are disposed as close to the feed rollers as possible.

Alternatively, the shutters may be linked with the feed rollers in such a manner that the shutters are retracted from the feed path when the feed rollers rotate, and are disposed above the feed rollers when the feed rollers are stalled.

A photosensitive material processing apparatus according to a second embodiment of the present invention comprises a processing tank for processing said photosensitive material by immersing the photosensitive material in a processing solution contained therein, feed rollers provided in said processing tank for nipping and transporting said photosensitive material, a photosensitive material feed path provided in said processing tank along which said photosensitive material passes, and shutters provided retractably with respect to the photosensitive material feed path situated above said feed rollers.

The operation of the present photosensitive material processing apparatus of the second embodiment will now be described.

In the photosensitive material processing apparatus, the photosensitive material is transported along the photosensitive material feed path in the processing tank by the feed rollers so as to be processed in a predetermined manner by the processing solution contained in the processing tank.

When the processing of the photosensitive materials is not conducted for a long time, such as a holiday or during the night, or when the apparatus is in the heat control state, the shutters are moved into the photosensitive material feed path above the feed rollers to block the photosensitive material feed path. This can prevent the floating materials in the processing solution from precipitating on the feed rollers.

When a photosensitive material is processed, the shutters are retracted from the photosensitive material feed path.

Preferably, the shutters are disposed as close to the feed rollers as possible.

Alternatively, the shutters may be linked with the feed rollers in such a manner that the shutters are retracted from the photosensitive material feed path when the feed rollers rotate, and are moved into the photosensitive material feed path when the feed rollers are stalled.

A photosensitive material processing apparatus according to a third embodiment of the present invention comprises a processing tank for processing said photosensitive material by immersing the photosensitive material in a processing solution contained therein, feed rollers provided in said processing tank for nipping and transporting said photosensitive material, a driving means for rotating said feed rollers, and a control means for intermittently driving said driving means when the processing of a photosensitive material is not conducted.

The operation of the present photosensitive material processing apparatus of the third embodiment will now be described.

In the photosensitive material processing apparatus, the control means intermittently drives the driving means for rotating the feed rollers when the processing of a photosensitive material is not conducted for a long time. This disperses the accumulations and prevents the deposition of the floating materials on the feed rollers by agitating the processing solution in the vicinity of the surfaces of the feed rollers. It also prevents soiling on a photosensitive material by changing the areas on the surfaces of feed rollers where soiling accumulates.

A photosensitive material processing apparatus according to a fourth embodiment of the present invention comprises a processing tank for processing said photosensitive material by immersing the photosensitive material in a processing solution contained therein, feed rollers provided in said processing tank for nipping and transporting said photosensitive material, a circulation means for circulating the processing solution in said processing tank, and a control means for intermittently driving said circulation means when the processing of a photosensitive material is not conducted.

The operation of the present photosensitive material processing apparatus of the fourth embodiment will now be described.

In the photosensitive material processing apparatus, the control means intermittently drives the circulation means for circulating the processing solution in the processing tank when the processing of a photosensitive material is not conducted for a long period of time. This allows the processing solution to be agitated to thereby prevent the floating materials in the processing solution from precipitating on the feed rollers. Further, this allows the materials already adhered to the feed rollers to be dispersed.

A photosensitive material processing apparatus according to a fifth embodiment of the present invention comprises a processing tank for processing said photosensitive material by immersing the photosensitive material in a processing solution contained therein, feed rollers provided in said processing tank for nipping and transporting said photosensitive material, a driving means for driving said feed rollers, a circulation means for circulating the processing solution in said processing tank, and a control means for intermittently driving said driving means and said circulation means when the processing of a photosensitive material is not conducted.

The operation of the present photosensitive material processing apparatus of the fifth embodiment will now be described.

In the photosensitive material processing apparatus, the control means intermittently drives the circulation means for circulating the processing solution in the processing tank and intermittently drives the driving means for rotating the feed rollers when the processing of a photosensitive material is not conducted. This allows the processing solution to be agitated to thereby prevent the floating materials from precipitating on the feed rollers and from adhering locally to the surface of the feed rollers, and the agitation prevents the floating materials from accumulating and disperses the adhered materials. Precipitation of the floating materials in the processing solution on the surface of the rollers can be prevented.

DESCRIPTION OF THE PREFERRED EMBODIMENTS

Figure 1:
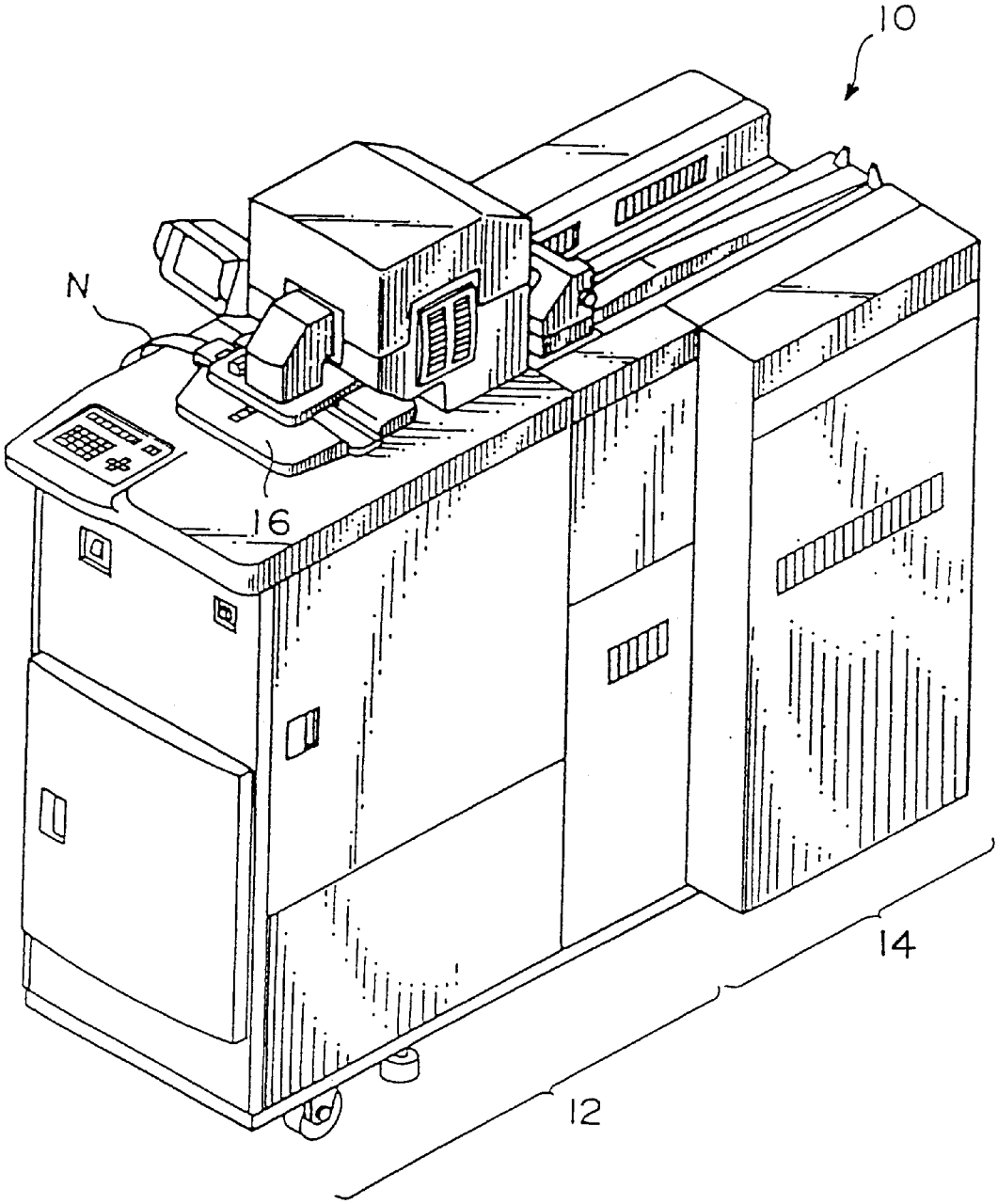
FIG. 1 is a perspective view of a printer-processor according to a first embodiment of the present invention.

First Embodiment:

FIG. 1 shows a printer-processor 10 serving as a photosensitive material processing apparatus used in the present invention.

The printer-processor 10 includes a printer section 12 and a processor section 14. In the printer section 12, images of a negative film N loaded in a negative carrier 16 are printed onto unillustrated photographic printing paper 40 serving as a photosensitive material. The photographic printing paper 40 is conveyed to the processor section 14.

In the processor section 14, a developing tank, a bleach-fixing tank, a rinsing tank and a drying portion (not shown in FIG. 1) are provided, wherein the photographic printing paper 40 conveyed from the printer section 12 is processed.

Next, a structure of the embodiment will be explained by using the developing tank inside each of the processing tanks as an example.

Figure 2:
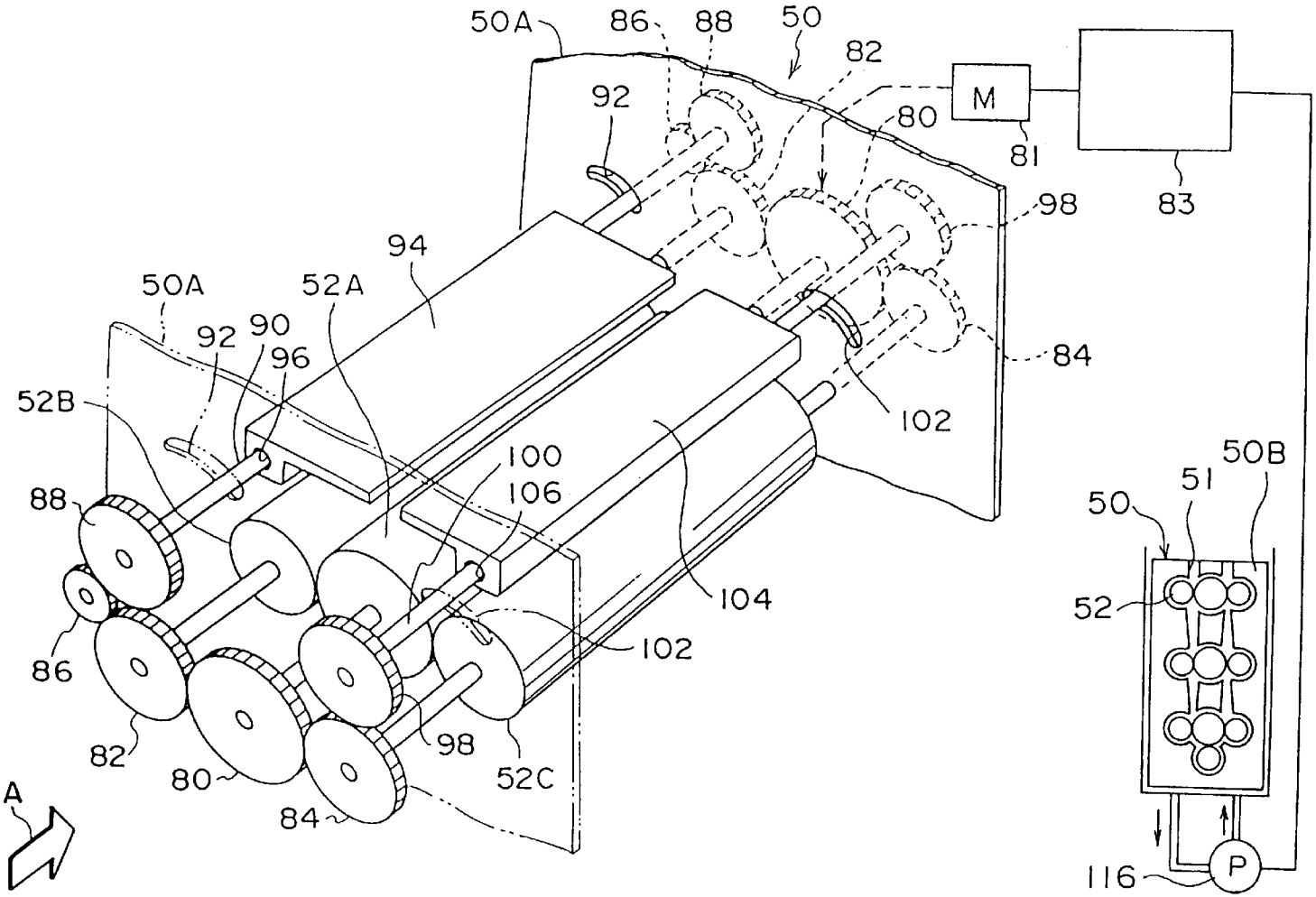
FIG. 2 is a perspective view in the vicinity of the shutters.

As shown in FIG. 2, a feed rack 50 disposed in the processing tank includes a pair of side panels 50A and a block 50B (See FIG. 3), which is disposed between the side panels 50A and in which a substantially U-shaped photographic printing paper passage 51 is formed, along which photographic printing paper 40 (not shown in FIG. 2) passes.

A plurality of rollers 52 are provided in the feed rack 50 so that the photographic printing paper 40 is nipped and transported along the photographic printing paper passage 51. Thus, the photographic printing paper 40 fed into a processing tank is guided and fed along a substantially U-shaped passage by the plurality of rollers 52 to thereby be immersed in the processing solution.

As shown in FIG. 2, gears 80 are fixed at both ends of a roller 52A disposed in the center, gears 82 at both ends of a roller 52B disposed on one side of the roller 52A, and gears 84 at both ends of a roller 52C disposed on the other side of the roller 52A. The gears 80 mesh with the gears 82 and 84.

The gears 80 of the roller 52A are connected to a motor 81 through a gear mechanism (not shown). The motor 81 is controlled by a controller 83.

The gears 82 mesh with small gears 86, with which the gears 88 mesh.

The gears 88 are fixed on a sliding shaft 90, and the shaft 90 is slidably inserted into curved slots 92 which are formed on the side panels 50A of the feed rack 50. The center of curvature of the slots 92 is the center of rotation center of the small gears 86, thus allowing the gears 88 to move within a predetermined range in the direction of the periphery of the small gears 86 while being engaged with the small gears 86.

The middle part of the sliding shaft 90 is rotatably inserted into a through hole 96, which is formed at one side end of a shutter 94 in the transporting direction of the photosensitive material.

The gears 98 mesh with gears 84.

The gears 98 are fixed on a sliding shaft 100, and the shaft 100 is slidably inserted into curved slots 102 which are formed on the side panels 50A of the feed rack 50. The center of curvature of the slots 102 is the center of rotation of the gears 84, thus allowing the gears 98 to move within a predetermined range in the direction of the periphery of the small gears 84 while being engaged with the small gears 84.

The middle part of the sliding shaft 100 is rotatably inserted into a through hole 106, which is formed at one side end of a shutter 104 in the transporting direction of the photosensitive material.

Figure 3:
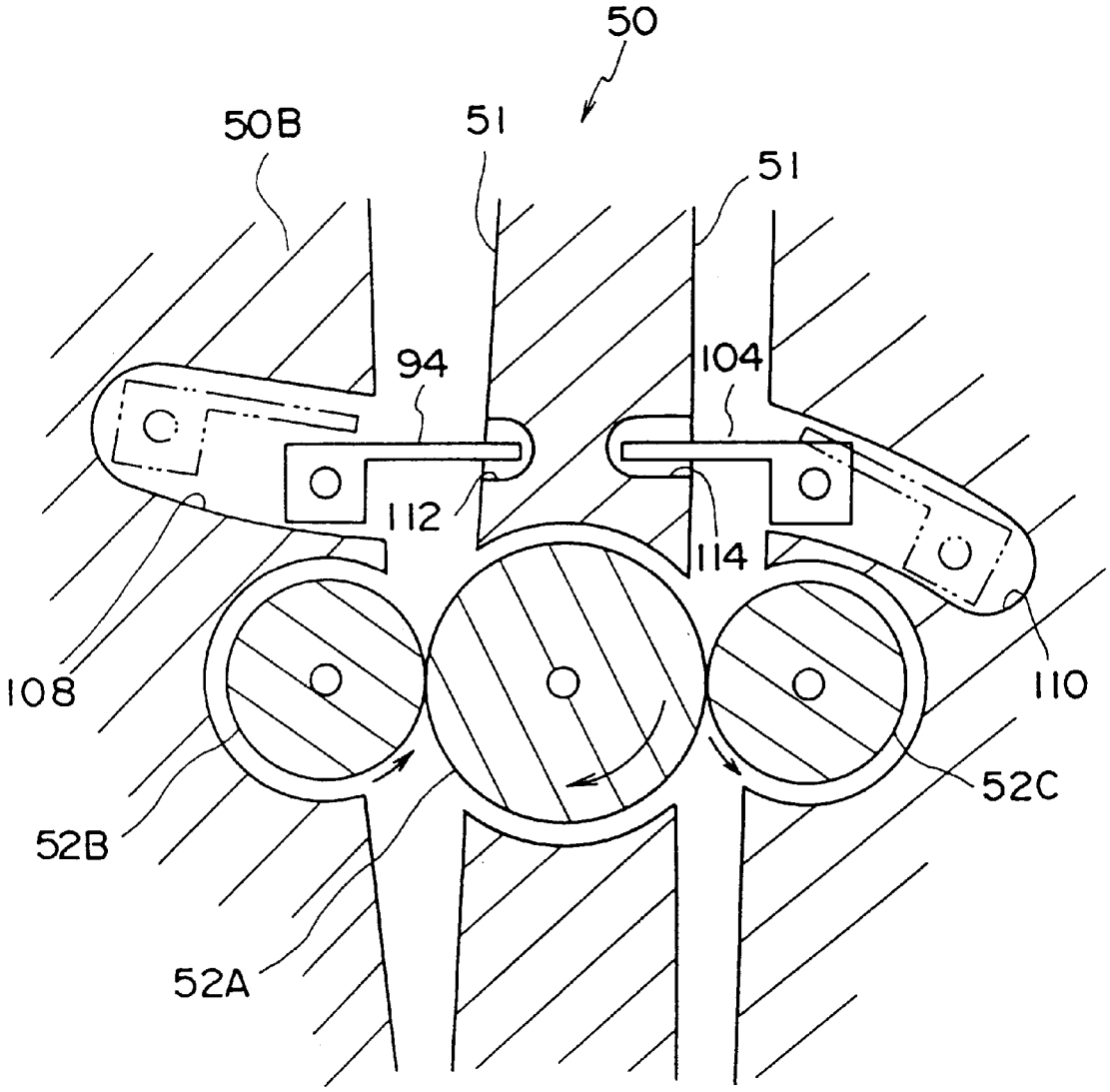
FIG. 3 is a side view illustrating that the passage of the photographic printing paper is being blocked by the shutters.

As shown in FIG. 3, a concave portion 108 into which the shutter 94 is protrudably and retractably inserted, and a concave portion 110 into which the shutter 104 is protrudably and retractably inserted, are formed in the block 50B. A concave portion 112 is formed on the surface of the block 50B opposite to the concave portion 108 in such a way that the top of the shutter 94 is inserted therein, and a concave portion 114 is formed on the surface of the block 50B opposite to the concave portion 110 in such a way that the top of the shutter 104 is inserted therein.

Further, the printer-processor 10 is equipped with a circulating pump 116 for circulating the processing solution in each processing tank. (FIG. 2 shows only one pump, yet in reality one circulating pump is provided for each processing tank.) These circulating pumps 116 are controlled by the controller 83.

Next, the operation of the first embodiment will be explained.

The photographic printing paper 40 fed into the processor section 14 is guided and fed into the feed racks 50 provided in the respective processing tanks to thereby undergo development, bleach-fix and rinsing processing.

As shown in FIG. 2, in the initial stage where the photographic printing paper 40 has not been conveyed, the shutter 94 is located above the rollers 52A and 52B which protrude in the photographic printing paper passage 51, and the shutter 104 is located above the rollers 52A and 52C which protrude in the photographic printing paper passage 51.

Figure 4:
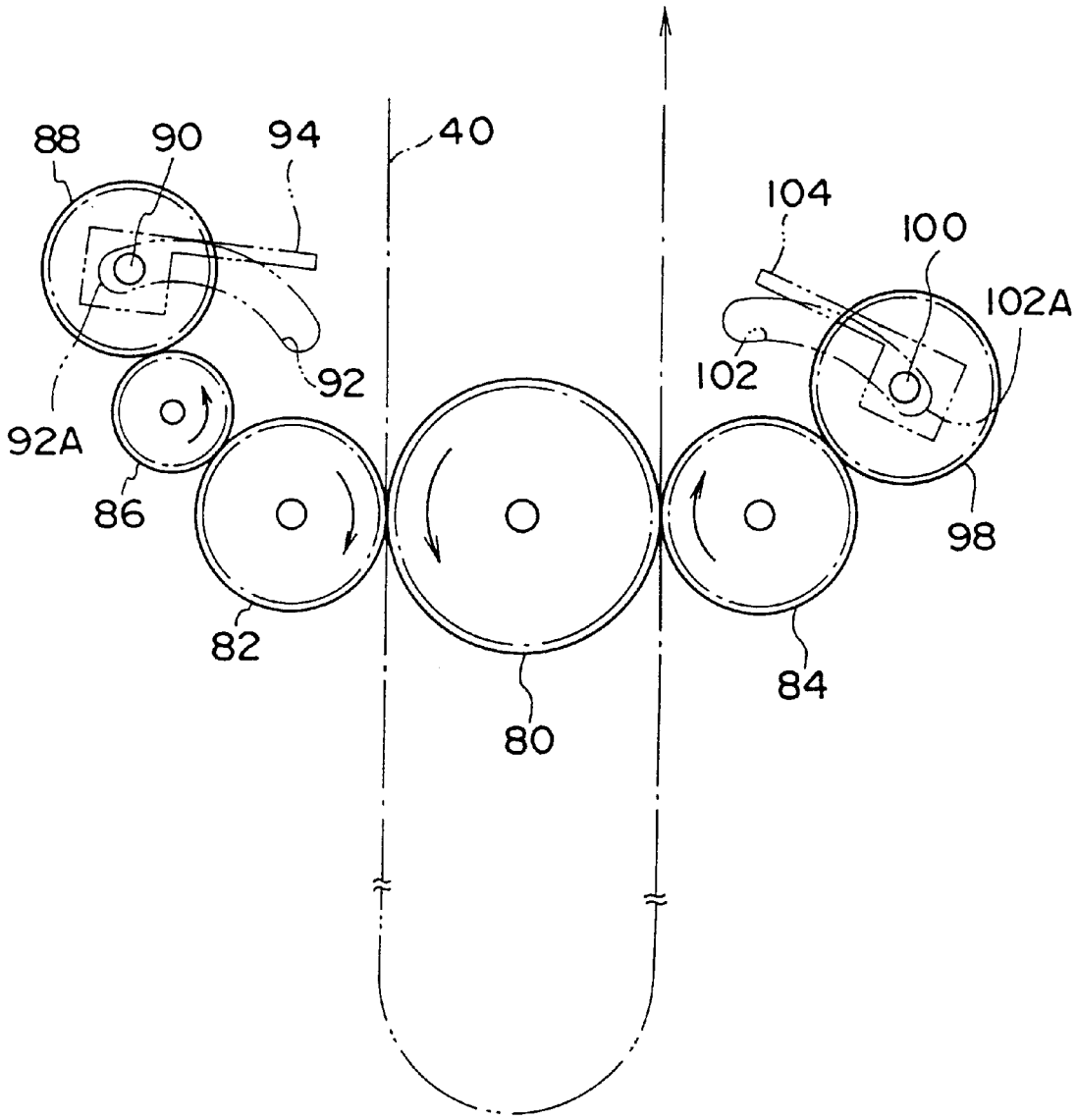
FIG. 4 is a side view illustrating the shutters being retracted from the passage of the photographic printing paper (photographic printing paper is being conveyed).

As shown in FIG. 4, as the gear 80 is rotated counterclockwise, when viewed from an arrow A in FIG. 2, to thereby transport the photographic printing paper 40, the gear 86 is rotated counterclockwise so that the gear 88 moves counterclockwise while being engaged with the gear 86. The sliding shaft 90 slides in the slots 92 toward the end portions 92A of the slots 92 until the shaft 90 abuts the end portions, where the shutter 94 is retracted from the photographic printing paper passage 51 (See the imaginary lines in FIG. 3) and the gear 88 keeps idling.

As the gear 80 is rotated counterclockwise, the gear 84 is rotated clockwise so that the gear 98 moves counterclockwise while being engaged with the gear 84. The sliding shaft 100 slides in the slots 102 toward the end portions 102A of the slots 102 until the shaft 100 abuts the end portions, where the shutter 104 is retracted from the photographic printing paper path 51 (See the imaginary lines in FIG. 3) and the gear 98 keeps idling.

When the processing of the photographic printing paper 40 will not be conducted for a long time after the processing of predetermined photographic printing paper 40 is completed, the gear 80 is reversely rotated (clockwise) after the last photographic printing paper 40 is processed.

Figure 5:
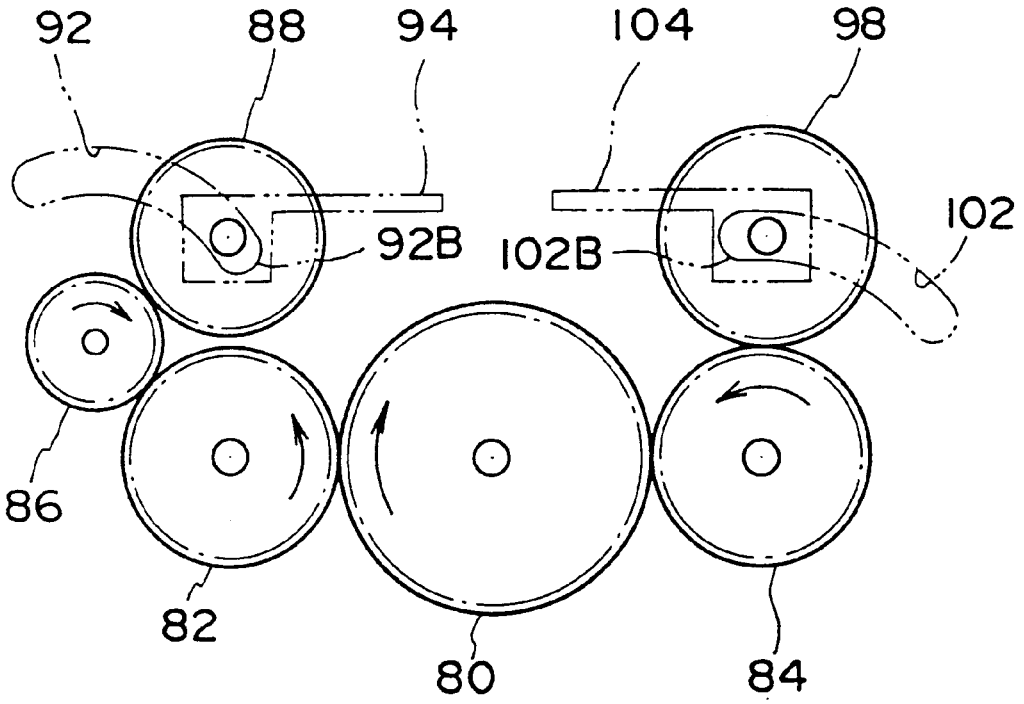
FIG. 5 is a side view of the shutters and gears while the passage of the photographic printing paper is being blocked.

As shown in FIG. 5, as the gear 80 is rotated clockwise, the gear 86 is rotated clockwise so that the gear 88 moves in a clockwise direction around the gear 86 while being engaged with the gear 86. The sliding shaft 90 slides in the slot 92 toward the end portions 92B of the slots 92 until the shaft 90 abuts the end portions, where the gear 88 keeps idling and, as shown in FIG. 3, the shutter 94 blocks the photographic printing paper passage 51 and is located above the rollers 52A and 52B which protrude in the photographic printing paper passage 51.

As the gear 80 is rotated clockwise, the gear 84 is rotated counterclockwise so that the gear 98 moves in a counterclockwise direction around the gear 84 while being engaged with the gear 84. The sliding shaft 100 slides in the slots 102 toward the end portions 102B of the slots 102 until the shaft 100 abuts the end portions, where the gear 98 keeps idling and the shutter 104 blocks the photographic printing paper passage 51 and is located above the rollers 52A and 52C which protrude in the photographic printing paper passage 51.

When the shutters 94 and 104 block the photographic printing paper passage 51, the motor 81 stops rotating.

Thus, when the shutters 94 and 104 cover the rollers 52A, 52B and 52C which protrude in the photographic printing paper passage 51 prior to a longtime shutdown of the transportation, the precipitation of floating materials, such as silver, sulfide and other soiling in the processing solution on the surfaces of rollers can be prevented.

Therefore, no floating material adheres to the first photographic printing paper 40 to be processed when the apparatus is actuated after a longtime shutdown, so that high-quality prints can always be obtained without contamination.

The term "a long time" herein refers to, for example, a period between the evening when a day's processing is completed and the next morning when the processing is started, without being a fixed period of time (as the time it takes for the floating materials to precipitate in the processing solution varies depending on the conditions of the apparatus, processing solution, and the like).

In the present embodiment, the shutters 94 and 104 are linked to the movement of rollers. Alternatively, another mechanism to move the shutters 94 and 104, such as a solenoid or a motor, may be equipped in such a way that the shutters 94 and 104 are movable irrespective of the movement of the rollers.

Second Embodiment:

A second embodiment of the present invention will be described hereinafter.

In the first embodiment described above, when the processing is not conducted for a long time, the shutters 94 and 104 are disposed to thereby cover the rollers 52A, 52B, and 52C so that floating materials in the processing solution do not precipitate on the top surfaces of rollers. In the printer-processor 10 of the second embodiment, thought not illustrated, the shutters 94 and 104 and their driving mechanism of the feed rack 50 are eliminated.

In the print processor 10 of the second embodiment, when the processing is not conducted for a long time, the rollers 52A, 52B, and 52C are intermittently rotated (irrespective of the rotating direction) to thereby change the position of the rollers (i.e. the position of the nips) periodically so that the floating materials do not accumulate locally on the rollers 52A, 52B, and 52C. Further, the floating materials adhered to the rollers 52A, 52B, and 52C are removed by agitating the processing solution around the surfaces of the rollers.

In the second embodiment, the absence of a shutter mechanism enables the use of a fewer components than those of the first embodiment.

Third Embodiment:

A third embodiment of the present invention will be described hereinafter.

In the printer-processor 10 of the third embodiment, when processing is not conducted for a long time, the circulation pump 116 is intermittently driven to thereby agitate the processing solution in the tank. This prevents the floating materials from precipitating on the surfaces of the rollers, and disperses the materials adhered to the rollers 52A, 52B, and 52C.

The third embodiment also does not require a shutter mechanism, which enables the use of a fewer components than those of the first embodiment.

When processing is not conducted for a long time, the rollers 52A, 52B, and 52C may be intermittently driven while the circulation pump 116 is intermittently driven.

While this invention has been described in conjunction with the specific embodiments wherein the invention is applied to the printer-processor 10 which processes the photographic printing paper 40, it is evident that this invention is also applicable to a photosensitive material processing apparatus which develops films such as negative films and other photosensitive materials.

What is claimed is:

1. A photosensitive material processing apparatus comprising:

a processing tank for processing a photosensitive material by immersing said photosensitive material in a processing solution contained therein;

feed rollers provided in said processing solution for nipping and transporting said photosensitive material; and shutters retractably provided above said feed rollers in said processing solution.

2. A photosensitive material processing apparatus according to claim 1 comprising a shutter driving means to drive said shutters.

3. A photosensitive material processing apparatus according to claim 2, wherein said shutter driving means retracts said shutters from above said feed rollers when said feed rollers rotate in the transporting direction of said photosensitive material, and disposes said shutters above said feed rollers when said rollers are rotated in the reverse direction.

4. A photosensitive material processing apparatus according to claim 2, wherein said shutter driving means receives a shutter driving force from a motor which rotates said feed rollers.

5. A photosensitive material processing apparatus according to claim 2, wherein said shutter driving means drives said shutters by the driving force from a motor which is different from the motor which rotates said feed rollers.

6. A photosensitive material processing apparatus according to claim 2, wherein said shutter driving means drives said shutters by the driving force from a solenoid.

7. A photosensitive material processing apparatus according to claim 1, wherein said shutters are disposed at least above the nip areas of said feed rollers when said rollers are rotated in the reverse direction.

8. A photosensitive material processing apparatus comprising:

a processing tank for processing a photosensitive material by immersing said photosensitive material in a processing solution contained therein;

feed rollers provided in said processing solution for nipping and transporting the photosensitive material;

a photosensitive material feed path provided in said processing tank along which said photosensitive material passes; and shutters provided retractably with respect to the photosensitive material feed path situated above said feed rollers in said processing solution.

9. A photosensitive material processing apparatus according to claim 8 comprising a shutter driving means to drive said shutters.

10. A photosensitive material processing apparatus according to claim 9, wherein said shutter driving means retracts said shutters from said photosensitive material feed path when said feed rollers rotate in the transporting direction of said photosensitive material, and blocks said photosensitive material feed path by moving said shutters into said photosensitive material feed path when said rollers are rotated in the reverse direction.

11. A photosensitive material processing apparatus according to claim 9, wherein said shutter driving means receives a shutter driving force from a motor which rotates said feed rollers.

12. A photosensitive material processing apparatus according to claim 9, wherein said shutter driving means drives said shutters by the driving force from a motor which is different from the motor which rotates said feed rollers.

13. A photosensitive material processing apparatus according to claim 9, wherein said shutter driving means drives said shutters by the driving force of a solenoid.

14. A photosensitive material processing apparatus comprising:

a processing tank for processing a photosensitive material by immersing said photosensitive material in a processing solution contained therein;

feed rollers provided in said processing solution for nipping and transporting the photosensitive material;

a driving means for driving said feed rollers; and a control means for intermittently driving said driving means when the processing of a photosensitive material is not conducted.

15. A photosensitive material processing apparatus comprising:

a processing tank for processing a photosensitive material by immersing the photosensitive material in a processing solution contained therein;

feed rollers provided in said processing solution for nipping and transporting the photosensitive material;

a circulation means for circulating the processing solution in said processing tank; and a control means for intermittently driving said circulation means when the processing of a photosensitive material is not conducted.

16. A photosensitive material processing apparatus comprising:

a processing tank for processing a photosensitive material by immersing said photosensitive material in a processing solution contained therein;

feed rollers provided in said processing solution for nipping and transporting the photosensitive material;

a driving means for driving said feed rollers;

a circulation means for circulating the processing solution in said processing tank; and a control means for intermittently driving said driving means and said circulation means when the processing of a photosensitive material is not conducted.

* * * * *